United States Patent [19]

Meijer et al.

[11] Patent Number: 4,785,875

[45] Date of Patent: Nov. 22, 1988

[54] HEAT PIPE WORKING LIQUID DISTRIBUTION SYSTEM

[75] Inventors: Roelf L. Meijer; Robert P. Verhey; Benjamin Ziph, all of Ann Arbor, Mich.

[73] Assignee: Stirling Thermal Motors, Inc., Ann Arbor, Mich.

[21] Appl. No.: 119,731

[22] Filed: Nov. 12, 1987

[51] Int. Cl.[4] ..... F28D 15/02

[52] U.S. Cl. ..... 165/104.25; 122/366; 165/104.26

[58] Field of Search ..... 165/104.26, 104.25; 122/366

[56] References Cited

U.S. PATENT DOCUMENTS

| | | | |
|---|---|---|---|
| 3,668,583 | 6/1972 | Nichols | 165/104.26 |
| 3,986,550 | 10/1976 | Mitsuoka | 165/104.26 |
| 4,252,185 | 2/1981 | Kosson | 165/104.25 |
| 4,422,501 | 12/1983 | Franklin et al. | 165/104.26 |
| 4,492,266 | 1/1985 | Bizzell et al. | 165/104.26 |
| 4,523,636 | 6/1985 | Meijer et al. | 165/104.26 |

*Primary Examiner*—Albert W. Davis, Jr.

*Attorney, Agent, or Firm*—Harness, Dickey & Pierce

[57] ABSTRACT

A heat pipe system particularly adapted for use with finned evaporators. In accordance with this invention, a separate liquid working fluid return conduit is provided which communicates with a liquid working fluid distribution means for distributing working fluid uniformly to all of the evaporator fins. Means are also provided in accordance with this invention for storing excess liquid working fluid either as a column of liquid within the liquid return pipe which is developed by a flow restrictor, or by selecting a distribution wick from a material having low capillary pressure which enables it to become saturated with liquid working fluid.

17 Claims, 3 Drawing Sheets

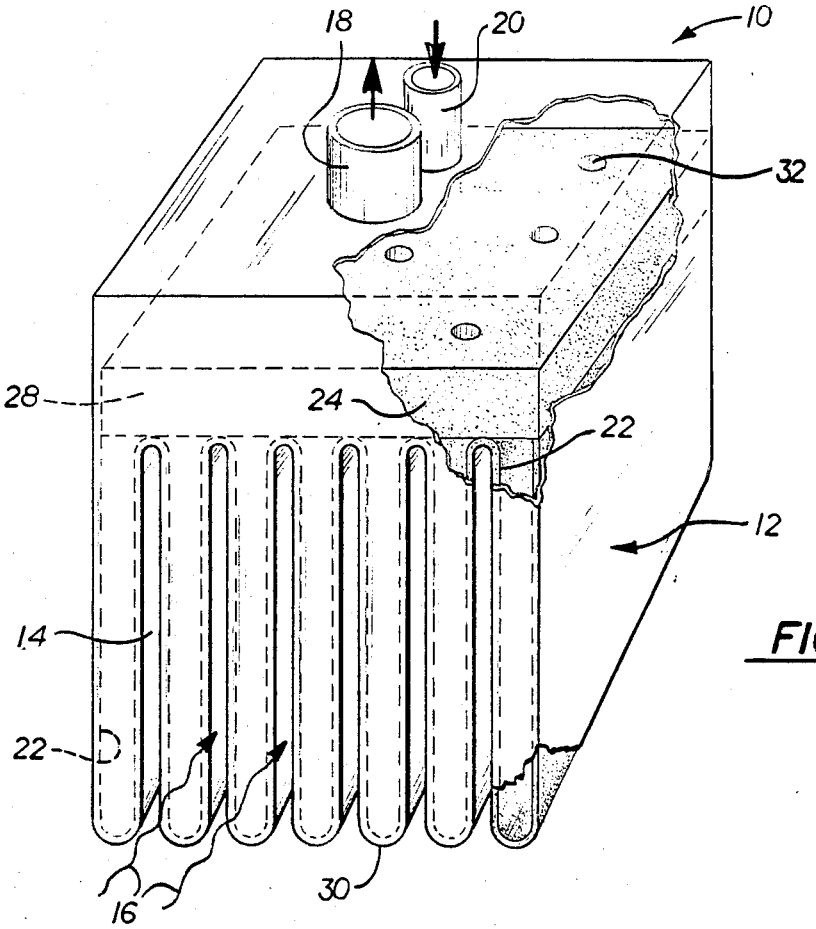
FIG. 1
FIG. 3
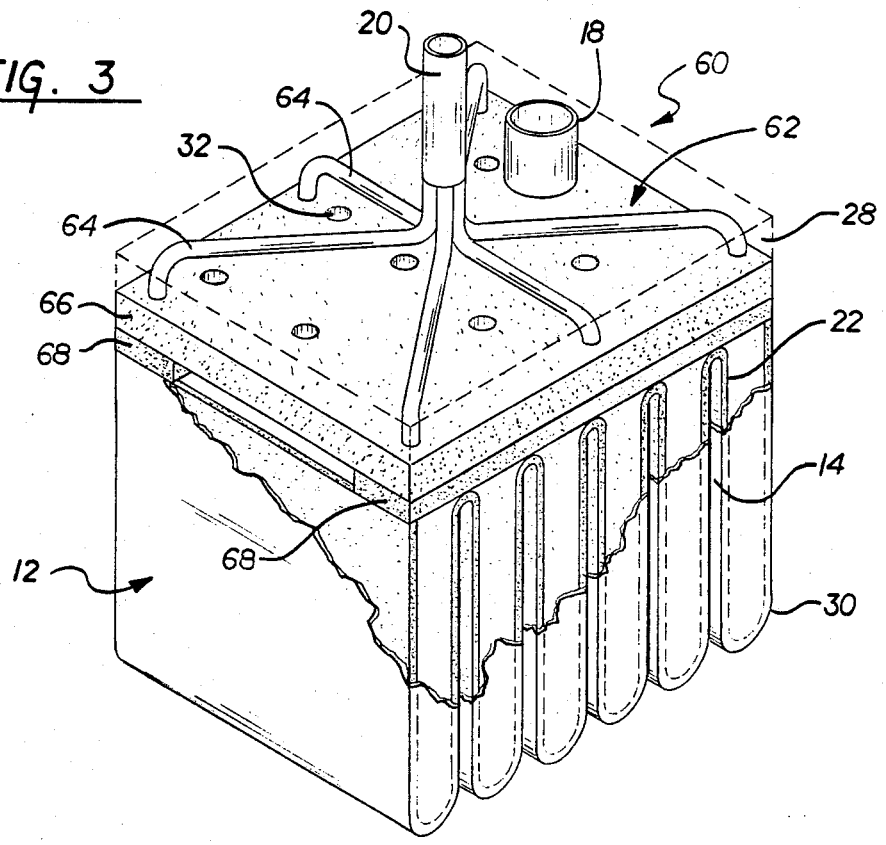

HEAT PIPE WORKING LIQUID DISTRIBUTION SYSTEM

BACKGROUND OF THE INVENTION

This invention relates to an improved heat pipe and particularly, to one having separate flow circuits for the vapor and liquid phases of the working fluid and means for distributing the returned liquid throughout the heat pipe evaporator.

Heat pipes are devices which efficiently transfer heat from their evaporator section to their condenser section. Working fluid inside the heat pipe absorbs heat in its evaporator portion causing the working fluid to vaporize. The vapor is transferred to the heat pipe condenser where it condenses, thus giving up its latent heat of evaporation. Liquid sodium and numerous other working fluids are used for heat pipes, depending on the temperature and pressure ranges of operation. Typically, the evaporator and condenser portions of the heat pipe are separated and the vapor and liquid working fluids flow within a connecting transport tube. As a means of distributing the liquid working fluid over the internal surface of the evaporator, a porous wick in the form of a woven mesh is often used which lines the inside surfaces of the heat pipe. The wick, due to the high capillary pressure it provides, causes returned liquid working fluid to be distributed about the surfaces of the evaporator.

Some heat pipe designs have a finned evaporator for absorbing heat from hot gases generated by a combustion furnace, internal combustion engine, or other sources. Heat transferred to the heat pipe condenser is dissipated to the environment or converted into another form of energy. In one system of the above type, the evaporator absorbs heat from hot flue gases from a combustor and the vaporized working fluid powers a Stirling cycle engine which provides a rotary or reciprocating output which can be employed to generate electricity, do direct work, etc.

In the application mentioned above in which a finned evaporator is used in connection with a Stirling engine or other applications where high fluid flow rates occur, a number of design constraints are presented. Since the vaporized working fluid leaving the evaporator being transmitted to the condenser or Stirling engine flows in a direction opposite that of liquid flow being returned to the evaporator, a problem of liquid entrainment within the vapor is presented. Such entrainment can prevent liquid from being returned to the evaporator resulting in drying out of the evaporator and possible perforation of the heat pipe housing caused by overheating.

For heat pipes with a finned evaporator, it is difficult to evenly distribute the returned liquid working fluid among all of the fins of the evaporator. Due to the finned evaporator configuration, the flow resistance of the liquid returned to a single point in the evaporator to the remotely located fins would be excessive to efficiently transport the liquid to those areas. Many heat pipe applications require the device to operate in tipped orientations. Therefore, any systems for distributing working fluid about the evaporator should be capable of operating through a range of heat pipe inclinations.

In the design of a heat pipe system of the type previously described, it is desirable to provide an excess of working fluid in order to accommodate a range of heat transfer rates of the heat pipe system. Excess amounts of liquid which are not being used for heat transfer must be stored. Simply allowing excess liquid to collect in the evaporator fins is unacceptable since the problems of boiling and shock waves would be encountered in those areas. Accordingly, there is a need to provide a system for storing liquid working fluid remote from the evaporator fins.

SUMMARY OF THE INVENTION

Several embodiments of heat pipe systems are disclosed herein which provide the above mentioned desirable features. For each of the embodiments, separate vapor and liquid flow paths are provided which separate the working fluid by its direction of flow and phase. In the first embodiment, the liquid is returned to a distribution wick which is in contact with the wick lining the individual fins of the evaporator. The distribution wick receives liquid working fluid and distributes it among the evaporator fins. In a second embodiment of this invention, a plurality of individual ducts distribute the returned liquid working fluid to each of the fins. In a third embodiment, a hybrid approach is employed in which a plurality of liquid return flow passages communicate with a distribution wick. In the fourth described embodiment, a header pipe with a number of distributing holes spreads the liquid along a distribution wick.

A means for storing excess liquid working fluid within the liquid return flow passage is also provided in accordance with this invention. A flow resistor within the liquid return conduit causes a head of liquid working fluid to develop in the liquid flow passage. The liquid return conduit thus acts as a reservoir for excess liquid working fluid, and further presents a pressure head which enables the working fluid to be transported to diverse areas of the evaporator despite various heat pipe inclinations.

Additional benefits and advantages of the present invention will become apparent to those skilled in the art to which this invention relates from the subsequent description of the preferred embodiments and the appended claims, taken in conjunction with the accompanying drawings.

BRIEF DESCRIPTION OF THE DRAWINGS

FIG. 1 is a partially cut-away pictorial view of a heat pipe evaporator in accordance with a first embodiment of this invention in which a distribution wick is employed to distribute returned liquid working fluid.

FIG. 3 is a partially cut-away pictorial view of a heat pipe evaporator in accordance with a third embodiment of this invention in which individual distribution pipes are used to transmit liquid working fluid to various areas of a distribution wick.

DETAILED DESCRIPTION OF THE INVENTION

Figure 2:
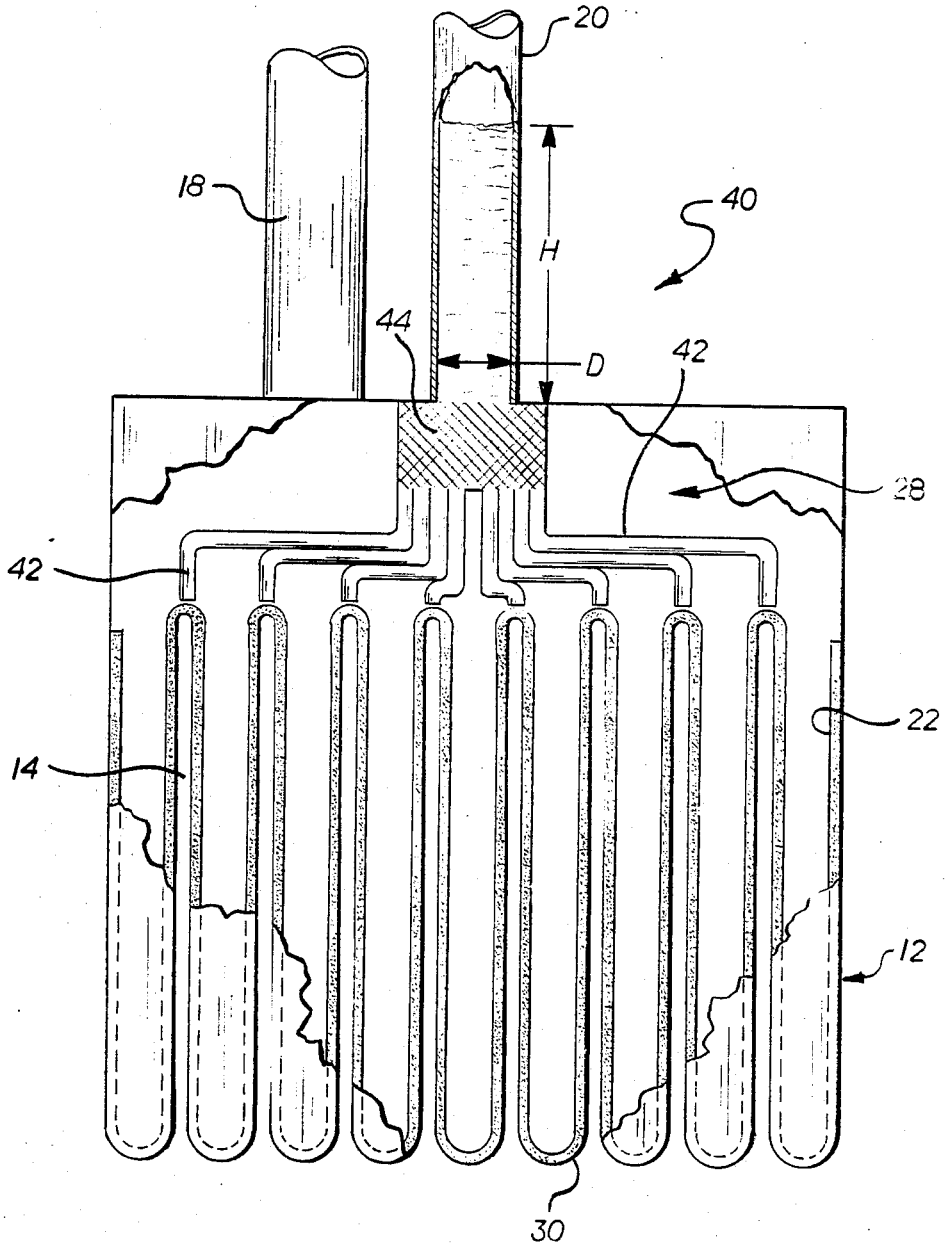
FIG. 2 is a cross-sectional view of a heat pipe evaporator in accordance with a second embodiment of this invention in which a plurality of distribution pipes are used to return working fluid to individual fins of the evaporator, and further employs a gauze plug to provide a reservoir for excess liquid working fluid.

A heat pipe in accordance with the first embodiment of this invention is shown in FIG. 1 and is generally designated by reference number 10. Heat pipe 10 includes a finned evaporator 12 which provides a plurality of hot gas flow channels 14 which absorb heat from gases which flow in the direction of arrows 16. Working fluid within evaporator 12 in the vapor phase is transmitted via vapor pipe 18 to a remote condenser or a Stirling cycle engine (not shown). Condensed working fluid is returned to evaporator 12 through liquid return pipe 20. As a means of distributing liquid working fluid, a layer of wick material 22 lines the inside surfaces of fins 30 of evaporator 12. Since evaporator 12 has separated vapor and liquid working fluid. conduits 18 and 20, these phases are maintained out of counterflow conditions where the previously mentioned problems of liquid entrainment can occur.

Unless a system is provided to distribute returned liquid working fluid throughout evaporator 12, the working fluid will tend to collect in a few of the evaporator fins while others will dry out, which can lead to mechanical failure of the heat pipe, as previously explained. Such drying out occurs because the flow resistance along wick 22 would be excessive for some of the fins. In accordance with the first embodiment of this invention, distribution wick 24 is provided which is disposed inside head space 28 of evaporator 12 which communicates with evaporator fins 30.

Once liquid working fluid is returned through pipe 20, it contacts and saturates distribution wick 24 due to capillary action. Distribution wick 24 contacts surface wick 22 along the root portions of each of fins 30. Due to this direct contact, liquid working fluid retained by distribution wick 24 is conducted to surface wick 22 and flows into each of fins 30 where it is available for absorbing heat and vaporizing. A number of holes 32 are provided through distribution wick 24 which provide a flow passage for vaporized working fluid escaping from fins 30.

Distribution wick 24 also can provide a liquid storage function. By making wick 24 of course material, it exhibits low capillary pressure enabling it to hold significant quantities of liquid.

With reference to FIG. 2, heat pipe 40 in accordance with a second embodiment of this invention is shown. Components of this embodiment and those described hereinafter having a configuration and function similar to those of the first embodiment are identified by like reference numbers. For this embodiment, liquid return pipe 20 terminates in a plurality of individual small diameter distribution pipes 42 which terminate at the root of each of evaporator fins 30. Distribution pipes 42 ensure that each of fins 30 is provided with its own source of liquid working fluid.

Heat pipe 40 further features a means of storing excess liquid working fluid. A flow resistor in a form of a gauze plug 44 is placed between distribution pipes 42 and liquid return pipe 20. Plug 44 acts as a restrictor such that liquid working fluid collects within liquid return pipe 20 above the plug, thus forming a reservoir.

The provision of gauze plug 44 for the embodiment shown in FIG. 2 further provides the advantage of rendering the system relatively insensitive to changes in inclination. The driving pressure of liquid caused by the height of liquid working fluid above plug 44, identified by reference letter H, is chosen to be large compared to diameter D of liquid return pipe 20 so that the pressure head acting on each of pipes 42 is relatively constant irrespective of minor changes in inclination of evaporator 12. Since gauze plug 44 is in contact with each of distribution pipes 42, it provides the additional advantage of distributing liquid working fluid among each of pipes 42.

A heat pipe in accordance with a third embodiment of this invention is illustrated in FIG. 3 and is generally designated there by reference number 60. This embodiment represents a hybrid of some of the features of the previously described embodiments in that it employs distribution wick 62 and plurality of distribution pipes 64. In many applications, evaporator 12 may have a sufficiently large number of individual fins 30 that it would not be feasible to provide individual dedicated distribution pipes 64 for each of the fins. A number of distribution pipes 64 are provided which communicate returned liquid working fluid to several points on distribution wick 62. As with the first embodiment, distribution wick 62 is in contact with surface wick 22 for distribution of the liquid working fluid to the individual fins 30.

For this third embodiment, a liquid working fluid buffer in the form of a gauze plug forming a pressure head of working fluid can be provided, like the second embodiment. Alternately, as with the first embodiment, distribution wick 62 can be designed to perform a liquid working fluid storage function. If the material making up distribution wick 62 has a course weave, low capillary pressure is provided, enabling the wick to hold a significant volume of working fluid. If, however, the distribution wick 62 has a tighter weave, capillary pressure will be increased and fluid distribution efficiency accordingly increased (with a reduction in storage capacity). In order to combine the features of liquid storage and distribution for wick 62, the wick is shown in FIG. 3 as being a composite article made of an upper storage portion 66, and a pair of distribution portion strips 68. Working fluid flowing into distribution wick 62 first contacts storage portion 66. Due to its lower capillary pressure, storage portion 66 retains a significant volume of liquid working fluid. Since, however, storage portion 66 is in contact with distribution portions strips 68, which has a higher capillary pressure, it is able to efficiently transport liquid working fluid to surface wick 22 lining evaporator fins 30.

Figure 4:
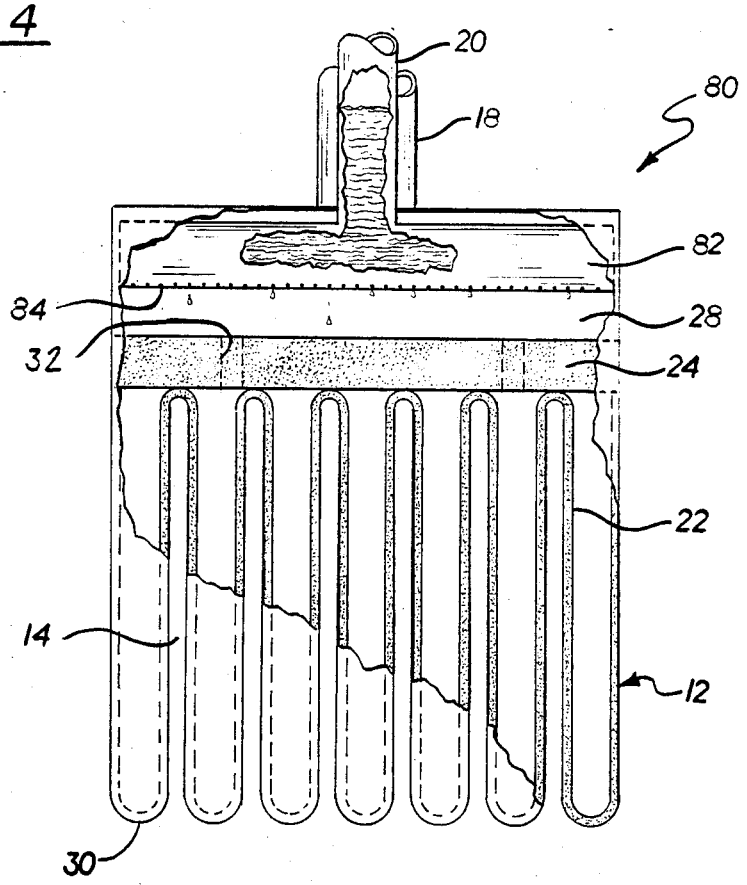
FIG. 4 is a partially cut-away pictorial view of a heat pipe evaporator in accordance with a fourth embodiment of this invention in which a header pipe is employed to distribute liquid working fluid about a distribution wick.
Figure 5:
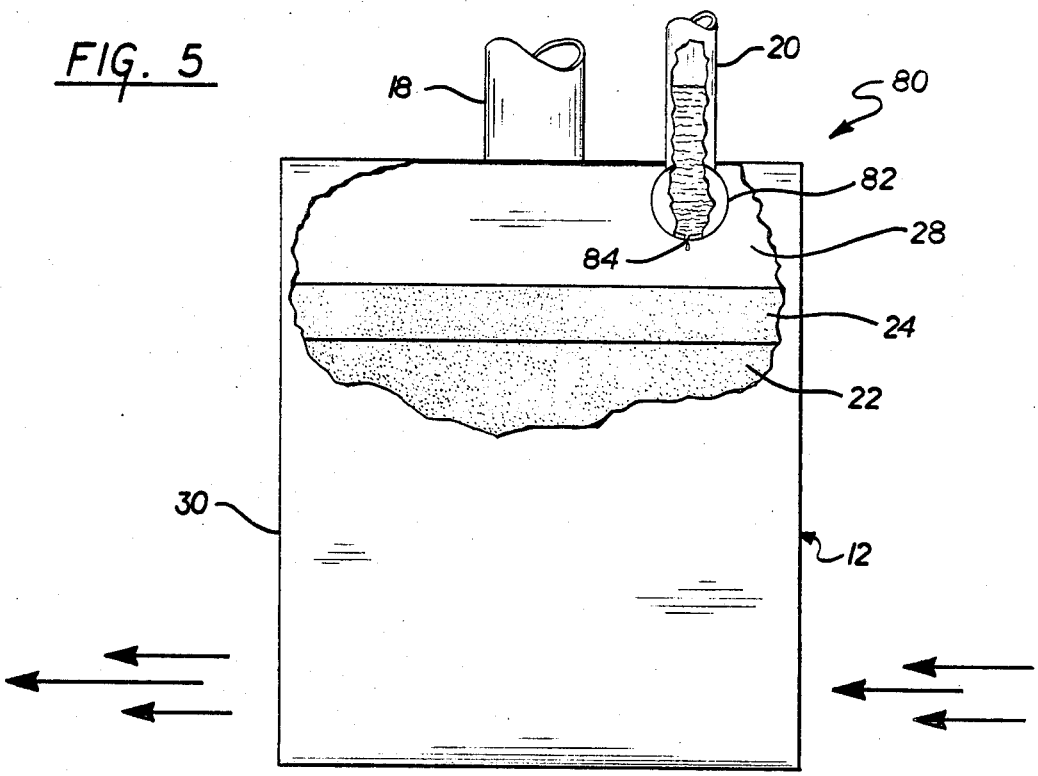
FIG. 5 is a partially cut-away side view of the heat pipe evaporator shown in FIG. 4.

A heat pipe in accordance with a fourth embodiment of this invention is shown in FIGS. 4 and 5 and is generally designated by reference number 80. For this embodiment liquid return pipe 20 joins a horizontally extending header pipe 82 which has a row of apertures 84 along its lower edge. Apertures 80 provide a restriction to the flow of liquid working fluid to cause a head of liquid working fluid to develop within liquid return pipe 20 as shown in FIG. 4. Liquid working fluid in the form of droplets falls from apertures 84 and is thus distributed about distribution wick 24 where it is then transported to surface wick 22 of fins 30. As in the previous embodiments, distribution wick 24 has a plurality of holes 32 therethrough for the transport of vaporized working fluid out of evaporator 12. As shown in FIG. 5, liquid return pipe 20 and header pipe 82 are laterally offset in the direction toward the side of finned evaporator 12 facing the oncoming hot gases, which flow in the direction designated by arrows in the figure. Since heat is removed from the gases as they traverse along finned evaporator 12, greater heat absorption capacity is required along the right hand portion fo evaporator 12. Accordingly, liquid working fluid is returned in the right hand portion of distribution wick 24 for efficient transport to the portions of fins 30 experiencing the highest heat transfer rates.

While the above description constitutes the preferred embodiments of the present invention, it will be appreciated that the invention is susceptible to modification, variation and change without departing from the proper scope and fair meaning of the accompanying claims.

We claim:

1. A heat pipe system comprising:

an evaporator where a working fluid is evaporated and transmitted away from said evaporator and returned thereto as a condensed liquid, said evaporator having a plurality of hollow fins which communicate with a head space area of said evaporator, a vapor pipe for transporting working fluid vapor from said evaporator, a liquid return pipe for returning condensed working fluid to said evaporator head space, a distribution wick disposed within said head space in commmunication with capillary means lining said fins, duct means within said head space transmitting liquid working fluid returned by said liquid return pipe to said distribution wick whereby said liquid is returned to said hollow fins.

2. a heat pipe system according to claim 1 wherein said means for distributing comprises a distribution wick disposed in said head space for receiving liquid working fluid from said liquid return pipe and contacting said capillary means comprising a surface wick which lines said evaporator fins whereby liquid flowing through said liquid return pipe is absorbed by said distribution wick and transmitted by capillary action to said surface wick.

3. A heat pipe system according to claim 2 wherein said distribution wick forms at least one hole therethrough enabling vaporized working fluid to be transported from said evaporator fins through said holes and out said vapor pipe.

4. A heat pipe system according to claim 2 wherein said distribution wick is a composite article made of at least two wick materials in which a first of said wick material provides a low capillary pressure thus storing significant quantities of said liquid working fluid, and a second portion thereof providing high capillary pressure for distribution of said working fluid to said evaporator fins.

5. A heat pipe system according to claim 1 wherein said duct means comprises a plurality of individual distribution pipes within said head space which transport liquid working fluid from said liquid return pipe to a plurality of locations within said evaporator.

6. A heat pipe system according to claim 5 wherein an individual distribution pipe is provided for each of said evaporator fins.

7. A heat pipe system according to claim 5 wherein the number of distribution pipes is less than the total number of said fins of said evaporator.

8. A heat pipe system according to claim 1 wherein said distribution means comprises a header pipe communicating with said liquid return pipe and having a plurality of apertures such that liquid within said header pipe is emitted from said apertures and distributed about said evaporator.

9. A heat pipe system according to claim 8 wherein said distribution means further comprises a distribution wick disposed in said head space and in contact with said surface wick whereby liquid working fluid emitted from said header pipe apertures is absorbed by said distribution wick and transported to said surface wick.

10. A heat pipe system according to claim 1 wherein said duct means comprises plurality of individual distribution pipes within said head space communicating with said distribution wick disposed within said head space whereby liquid working fluid in said liquid return pipe flows through said distribution pipes and onto said distribution wick, said distribution wick being in contact with a surface wick lining said evaporator fins.

11. A heat pipe system according to claim 1 further comprising excess liquid working fluid storage means for storing excess quantities of said working fluid remote from said evaporator fins.

12. A heat pipe system according to claim 11 wherein said storage means comprises a working fluid flow restrictor placed within said liquid return pipe for generating a reservoir of liquid working fluid within said liquid return pipe.

13. A heat pipe system according to claim 12 wherein said flow restrictor is formed from a plug of mesh material.

14. A heat pipe system comprising:

an evaporator where a working fluid is evaporated and transmitted away from said evaporator and returned thereto as a condensed liquid, said evaporator having a plurality of hollow fins which communicate with a head space area of said evaporator, a vapor pipe for transporting working fluid vapor from said evaporator, a liquid return pipe for returning condensed working fluid to said evaporator head space, and means within said head space for distributing liquid working fluid returned by said liquid return pipe among said evaporator fins including a plurality of individual distribution pipes within said head space and a distribution wick disposed within said head space whereby liquid working fluid in said liquid return pipe flows through said distribution pipes and onto said distribution wick, said distribution wick being in contact with a surface wick lining said evaporator fins.

15. A heat pipe system according to claim 14 further comprising excess liquid working fluid storage means for storing excess quantities of said working fluid remote from said evaporator fins.

16. A heat pipe system according to claim 15 wherein said storage means comprises a working fluid flow restrictor placed within said liquid return pipe for generating a reservoir of liquid working fluid within said liquid return pipe.

17. A heat pipe system according to claim 16 wherein said flow restrictor is formed for a plug of mesh material.

* * * * *